US010385804B2

(12) United States Patent
Okada et al.

(10) Patent No.: US 10,385,804 B2
(45) Date of Patent: Aug. 20, 2019

(54) SINGLE CYLINDER INTERNAL COMBUSTION ENGINE

(71) Applicant: HONDA MOTOR CO., LTD., Tokyo (JP)

(72) Inventors: Nozomi Okada, Wako (JP); Toru Kisaichi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 8 days.

(21) Appl. No.: 15/712,880

(22) Filed: Sep. 22, 2017

(65) Prior Publication Data

US 2018/0087471 A1 Mar. 29, 2018

(30) Foreign Application Priority Data

Sep. 29, 2016 (JP) ..... 2016-191697

(51) Int. Cl.

| | |
|---|---|
| ***F01M 13/00*** | (2006.01) |
| ***F02F 7/00*** | (2006.01) |
| ***F02F 1/24*** | (2006.01) |
| ***F01L 1/053*** | (2006.01) |
| *F02B 75/16* | (2006.01) |
| *F01L 1/047* | (2006.01) |
| *F01M 13/04* | (2006.01) |

(52) U.S. Cl.

CPC ..... *F02F 7/006* (2013.01); *F01L 1/053* (2013.01); *F01M 13/00* (2013.01); *F02F 1/242* (2013.01); *F02F 7/0004* (2013.01); *F01L 2001/0476* (2013.01); *F01L 2001/0537* (2013.01); *F01M 13/0416* (2013.01); *F02B 75/16* (2013.01); *F02F 2007/0063* (2013.01)

(58) Field of Classification Search

CPC .. F02F 7/006; F02F 1/242; F02F 7/004; F02F 2007/0063; F01L 1/053; F02L 2001/0476; F02L 2001/0537; F01M 13/00; F02B 75/16

USPC ..... 123/572–574, 90.27

See application file for complete search history.

(56) References Cited

U.S. PATENT DOCUMENTS 4,883,027 A * 11/1989 Oikawa ..... F01L 1/267 123/90.16
5,003,937 A * 4/1991 Matsumoto ..... F01L 1/053 123/90.12

(Continued)

FOREIGN PATENT DOCUMENTS

DE 197 57 286 A1 7/1998
JP S59-213911 A 12/1984

(Continued)

*Primary Examiner* — Marguerite J McMahon

(74) *Attorney, Agent, or Firm* — Birch, Stewart, Kolasch & Birch, LLP

(57) ABSTRACT

In a single cylinder internal combustion engine in which a plug hole is provided striding between a cylinder head and a head cover, and an intake side camshaft and an exhaust side camshaft are disposed at positions sandwiching the plug hole therebetween, a long hole portion formed long in a direction orthogonal to axes of the camshafts is formed as a part of the plug hole. A part of a plurality of cam holder attaching bolts used for fastening the cam holder to the cylinder head are disposed within the long hole portion. A breather chamber disposed around the long hole portion is formed between the head cover and a breather plate attached thereto.

14 Claims, 10 Drawing Sheets

(56) References Cited

U.S. PATENT DOCUMENTS

| | | | | |
|---|---|---|---|---|
| 6,223,709 | B1 * | 5/2001 | Takahashi | F01L 1/0532 123/193.5 |
| 6,237,577 | B1 | 5/2001 | Takahashi et al. | |
| 7,047,955 | B2 * | 5/2006 | Ookawa | F01M 13/022 123/572 |
| 8,065,993 | B2 * | 11/2011 | Festag | F01M 13/0416 123/572 |
| 2008/0011280 | A1 | 1/2008 | Tawarada et al. | |
| 2008/0223348 | A1 | 9/2008 | Togasawa | |
| 2009/0071421 | A1 * | 3/2009 | Maehara | F01L 1/053 123/41.86 |
| 2010/0044136 | A1 | 2/2010 | Suzuki | |
| 2010/0242871 | A1 * | 9/2010 | Sato | F01L 1/022 123/54.4 |
| 2010/0242875 | A1 * | 9/2010 | Cho | F01L 1/267 123/90.15 |
| 2016/0090883 | A1 | 3/2016 | Nishiguchi et al. | |

FOREIGN PATENT DOCUMENTS

| | | | |
|---|---|---|---|
| JP | 2000-87722 | A | 3/2000 |
| JP | 2002-129929 | A | 5/2002 |
| JP | 2002-155800 | A | 5/2002 |
| JP | 3627463 | B2 | 3/2005 |
| JP | 2006-283594 | A | 10/2006 |
| JP | 2008-19788 | A | 1/2008 |
| JP | 2008-223596 | A | 9/2008 |
| JP | 2016-70072 | A | 5/2016 |

* cited by examiner

SINGLE CYLINDER INTERNAL COMBUSTION ENGINE

BACKGROUND OF THE INVENTION

Field of the Invention

The present invention relates to a single cylinder internal combustion engine, in which a plug hole is provided striding between a cylinder head and a head cover joined to the cylinder head, and an intake side camshaft and an exhaust side camshaft are disposed at positions that sandwich the plug hole therebetween, the intake side camshaft and the exhaust side camshaft being sandwiched between the cylinder head and a cam holder joined to the cylinder head.

Description of the Related Art

A multi-cylinder internal combustion engine in which plural cylinders are arrayed in series is known in Japanese Patent No. 3627463 in which a breather plate is attached to a head cover so as to form a breather chamber between the breather plate and the head cover, the breather plate extending long in the cylinder arraying direction, the breather chamber surrounding plural plug holes, and an inlet and an outlet of the breather chamber are disposed so as to be apart from each other in the longitudinal direction of the breather plate in order to improve the gas/liquid separation performance that is achieved by the breather chamber.

However, although the construction disclosed in above Japanese Patent No. 3627463 is effective in a multi-cylinder internal combustion engine, with respect to a single cylinder internal combustion engine, since the cylinder head and the head cover are small, according to the technology disclosed in above Japanese Patent No. 3627463, it is hard to improve the performance of gas/liquid separation between the inlet and outlet of the breather chamber while keeping up compactization of the internal combustion engine.

SUMMARY OF THE INVENTION

The present invention has been achieved in view of the above-mentioned circumstances, and it is an object thereof to provide a single cylinder internal combustion engine that can keep up compactization while improving the gas/liquid separation performance at the breather chamber.

In order to achieve the object, according to a first feature of the present invention, there is provided a single cylinder internal combustion engine, in which a plug hole is provided striding between a cylinder head and a head cover joined to the cylinder head, and an intake side camshaft and an exhaust side camshaft are disposed at positions that sandwich the plug hole therebetween, the intake side camshaft and the exhaust side camshaft being sandwiched between the cylinder head and a cam holder joined to the cylinder head, wherein a long hole portion is formed as a part of the plug hole, the long hole portion being formed long in a direction orthogonal to axes of the intake side camshaft and the exhaust side camshaft, a part of a plurality of cam holder attaching bolts are disposed within the long hole portion of the plug hole, the plurality of cam holder attaching bolts being used for fastening the cam holder to the cylinder head, and a breather chamber is formed between a breather plate and the head cover, the breather chamber being disposed around the long hole portion, the breather plate being attached to the head cover.

With the first feature of the present invention, since the breather chamber is disposed around the long hole portion that is formed in a part of the plug hole, the gas circulation route within the breather chamber can be made comparatively long to improve the gas/liquid separation performance even in the single cylinder, and a part of plural cam holder attaching bolts are disposed within the long hole portion. Accordingly, even when a part of the plug hole is made the long hole portion, a disposal space for the cam holder attaching bolts which is required to be secured outside the plug hole is prevented from becoming large, and thereby the present invention can contribute to compactization of the internal combustion engine.

According to a second feature of the present invention, in addition to the first feature, the breather chamber is formed so as to surround the long hole portion of the plug hole, a part of a cam chain chamber is formed in the cylinder head, the cam chain chamber being provided with a cam chain transmitting rotational power to the intake side camshaft and the exhaust side camshaft, an inlet of the breather chamber is formed in the breather plate so as to be positioned between the plug hole and the cam chain chamber on a projection view to a flat plane that is parallel to a joining surface of the cylinder head and the head cover, and a partition wall is arranged integrally with the cam holder so as to protrude to the head cover side, the partition wall being disposed between the cam chain chamber and the inlet on the projection view.

With the second feature of the present invention, since the breather chamber is formed so as to surround the long hole portion of the plug hole and the inlet of the breather chamber is positioned between the plug hole and the cam chain chamber on a projection view to a flat plane that is parallel to the joining surface of the cylinder head and the head cover, the gas circulation route from the inlet to the outlet of the breather chamber can be made long, and, since the partition wall is disposed between the cam chain chamber and the inlet, the partition wall being arranged integrally in the cam holder so as to protrude toward the head cover side, the oil mist can be suppressed from intruding into the inlet of the breather chamber from the cam chain chamber side, and the breather performance can be improved.

According to a third feature of the present invention, in addition to the second feature, a lubricating oil passage is formed within the partition wall, the lubricating oil passage guiding a lubricating oil to the exhaust side camshaft side.

With the third feature of the present invention, since the lubricating oil passage is formed within the partition wall, increase of the weight of the cam holder and increase of the weight of the engine body caused by provision of the partition wall can be suppressed.

According to a fourth feature of the present invention, in addition to the second feature or the third feature, the breather plate is formed integrally with a breather plate main portion and a connecting portion, the breather plate main portion being formed in a substantially U-shape surrounding the long hole portion, the connecting portion connecting opposite end portions of the breather plate main portion to each other, and the inlet and an outlet of the breather chamber are disposed at positions that sandwich the connecting portion therebetween.

With the fourth feature of the present invention, the breather plate integrally includes the breather plate main portion of a substantially U-shape and the connecting portion that connects opposite end portions of the breather plate main portion to each other, the inlet and the outlet are disposed at the positions that sandwich the connecting portion therebetween, therefore the rigidity of the breather plate can be secured while securing the gas circulation route in the breather chamber long. Also, it can contribute to improvement of the productivity and the assembly performance of the breather plate.

According to a fifth feature of the present invention, in addition to the fourth feature, the inlet of the breather chamber is disposed at a center portion of the head cover on the projection view to the flat plane that is parallel to the joining surface of the cylinder head and the head cover.

With the fifth feature of the present invention, since the inlet of the breather chamber exists at the center portion of the head cover, even when the cylinder axis is tilted largely, the inlet of the breather chamber comes to be disposed higher than the lower portion of a space between the cylinder head and the head cover, intrusion of the oil mist to the breather chamber can be suppressed, and the breather performance can be further improved.

According to a sixth feature of the present invention, in addition to the second feature or the third feature, a pair of the cam holder attaching bolts are disposed within the long hole portion, the pair of the cam holder attaching bolts being disposed between the intake side camshaft and the exhaust side camshaft out of the cam holder attaching bolts that are respectively disposed on opposite sides of the intake side camshaft and the exhaust side camshaft.

With the sixth feature of the present invention, since a pair of the cam holder attaching bolts disposed between the intake side camshaft and the exhaust side camshaft are disposed within the long hole portion of the plug hole, the cylinder head can be made compact, the pair of the cam holder attaching bolts disposed between the intake side camshaft and the exhaust side camshaft are prevented from interfering with the breather chamber, and thereby the breather chamber can be formed larger and the breather performance can be further improved.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be explained referring to FIG. 1 to FIG. 10 attached. Also, in the explanation described below, directions of up, down, front, rear, left, and right are to be defined based on the eye line of an occupant riding a two-wheeled motor vehicle.

Figure 1:
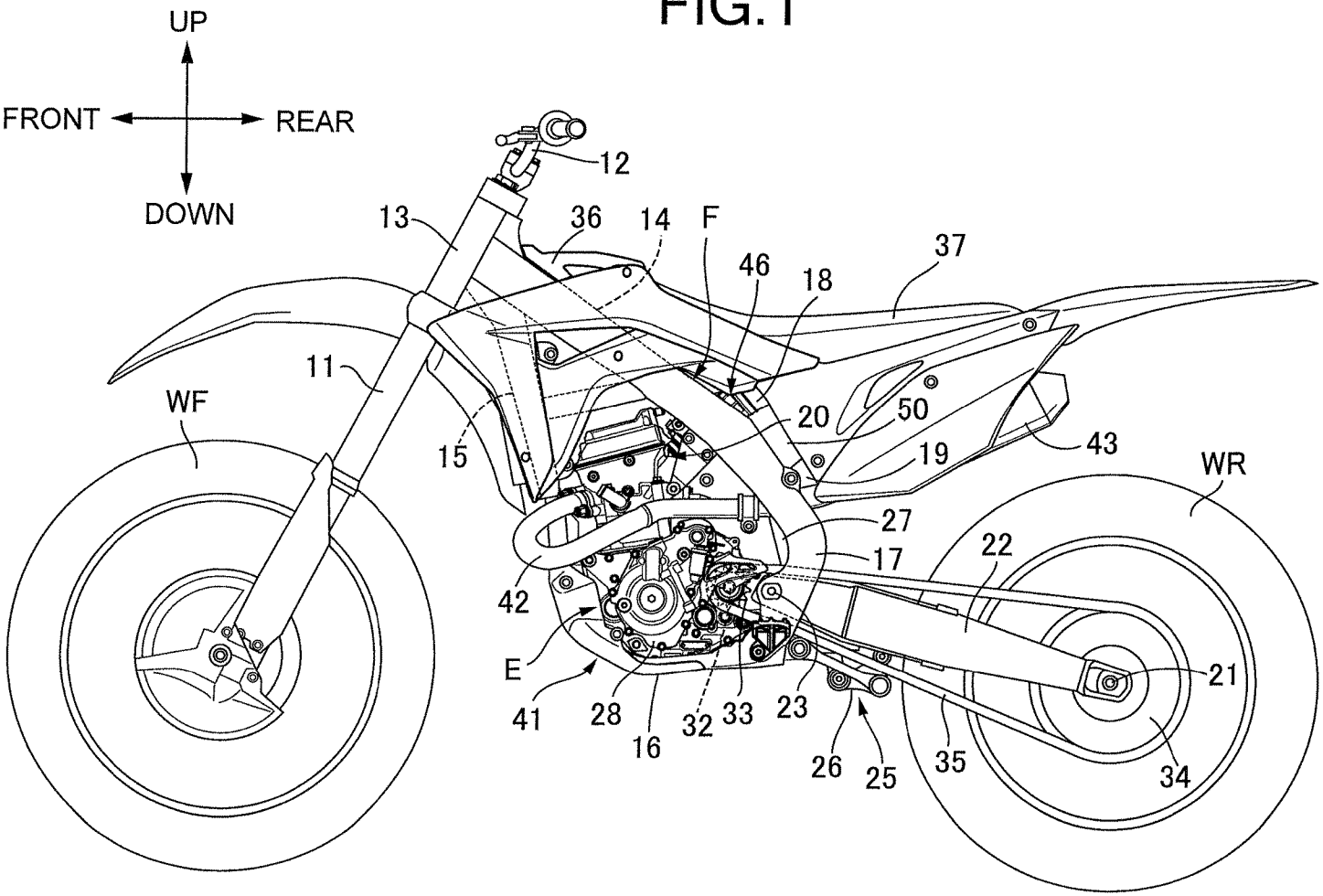
FIG. 1 is a left side view of a two-wheeled motor vehicle.

First, in FIG. 1, a body frame F of a two-wheeled motor vehicle that is for rough terrain travel includes a head pipe 13, a pair of left and right main frames 14, a down frame 15, a pair of left and right lower frames 16, a pair of left and right pivot frames 17, a pair of left and right seat rails 18, and a pair of left and right rear frames 19, the head pipe 13 steerably supporting a front fork 11 pivotally supporting a front wheel WF and a steering handlebar 12 having a bar shape, the pair of left and right main frames 14 extending downward to the rear from the head pipe 13, the down frame 15 extending downward to the rear at a steeper angle than the main frames 14 from the head pipe 13, the pair of left and right lower frames 16 being connected to the lower end portions of the down frames 15 and extending rearward, the upper end portions of the pair of left and right pivot frames 17 connected integrally to the rear end portions of the main frames 14 and extending downward, the rear end portions of the both lower frames 16 being connected to the lower end portions of the pair of left and right pivot frames 17, the pair of left and right seat rails 18 being connected to the rear end portions of the main frames 14 and extending rearward, the front end portions of the pair of left and right rear frames 19 being connected to the intermediate portions in the up-down direction of the both pivot frames 17 and extending upward to the rear, the rear end portions of the pair of left and right rear frames 19 being connected to the pivot frames 17.

On the body frame F, an engine body 20 of a single cylinder internal combustion engine E is mounted so as to be disposed below the main frames 14 as seen in a side view. An axle 21 of a rear wheel WR is pivotally supported by the rear end portion of a swing arm 22, and the front end portion of this swing arm 22 is supported by the lower portions of the pivot frames 17 in the body frame F through a spindle 23 in a up-down swingable manner.

A link mechanism 25 is arranged between a bracket 24 and the swing arm 22, the bracket 24 being arranged in the lower portion of the pivot frames 17 in the body frame F, and a rear cushion unit 27 that extends in the up-down direction is arranged between a link member 26 and the upper portion of the pivot frames 17, the link member 26 configuring a part of the link mechanism 25.

A transmission not illustrated is stored within a crankcase 28 that configures a part of the engine body 20, an output shaft 32 of the transmission protrudes sideways to the left from the crankcase 28, and a drive chain 35 of an endless shape is wound around a driving sprocket 33 and a driven sprocket 34, the driving sprocket 33 being arranged on the output shaft 32, the driven sprocket 34 being arranged on the axle 21 of the rear wheel WR.

Also, a fuel tank 36 is arranged above the engine body 20 and on the both main frames 14, and a riding seat 37 is disposed behind the fuel tank 36 so as to be supported by the seat rail 18.

Figure 2:
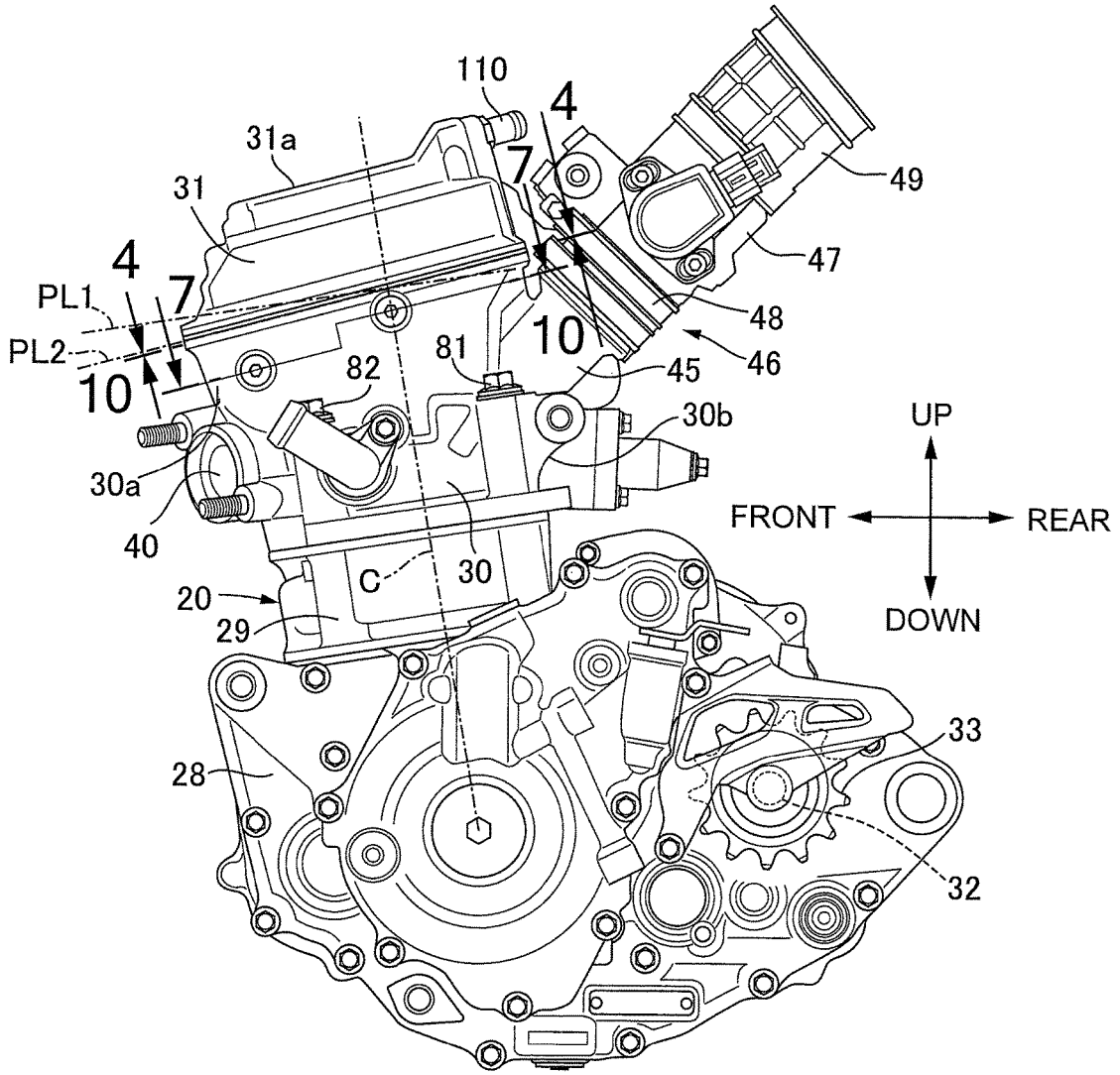
FIG. 2 is a left side view of an internal combustion engine.
Figure 3:
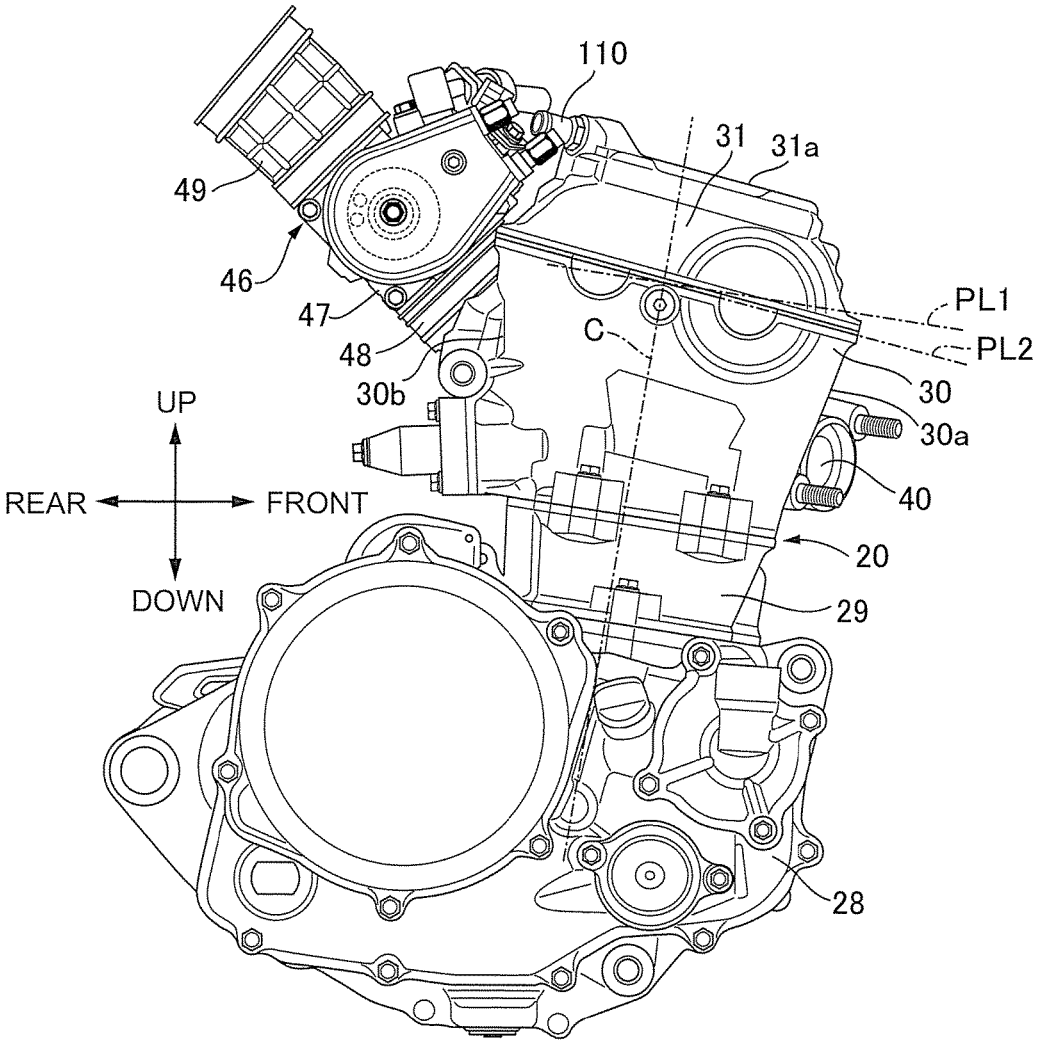
FIG. 3 is a right side view of the internal combustion engine.

With reference also to FIG. 2 and FIG. 3, the engine body 20 includes the crankcase 28, a cylinder body 29, a cylinder head 30, and a head cover 31, the cylinder body 29 being joined to the front side upper portion of the crankcase 28 and extending upward, the cylinder head 30 being joined to the upper portion of the cylinder body 29, the head cover 31 being joined to the upper portion of the cylinder head 30, and the engine body 20 is mounted on the body frame F with an attitude that a cylinder axis C is slightly tilted forward. Also, the cylinder head 30 and the head cover 31 are joined to each other on a second flat plane PL2 that crosses the cylinder axis C with the forward tilt angle slightly enlarged than a first plane PL1 that tilts so as to be positioned at an upper position as it goes to the rear along a vehicle longitudinal direction and is orthogonal to the cylinder axis C.

Figure 4:
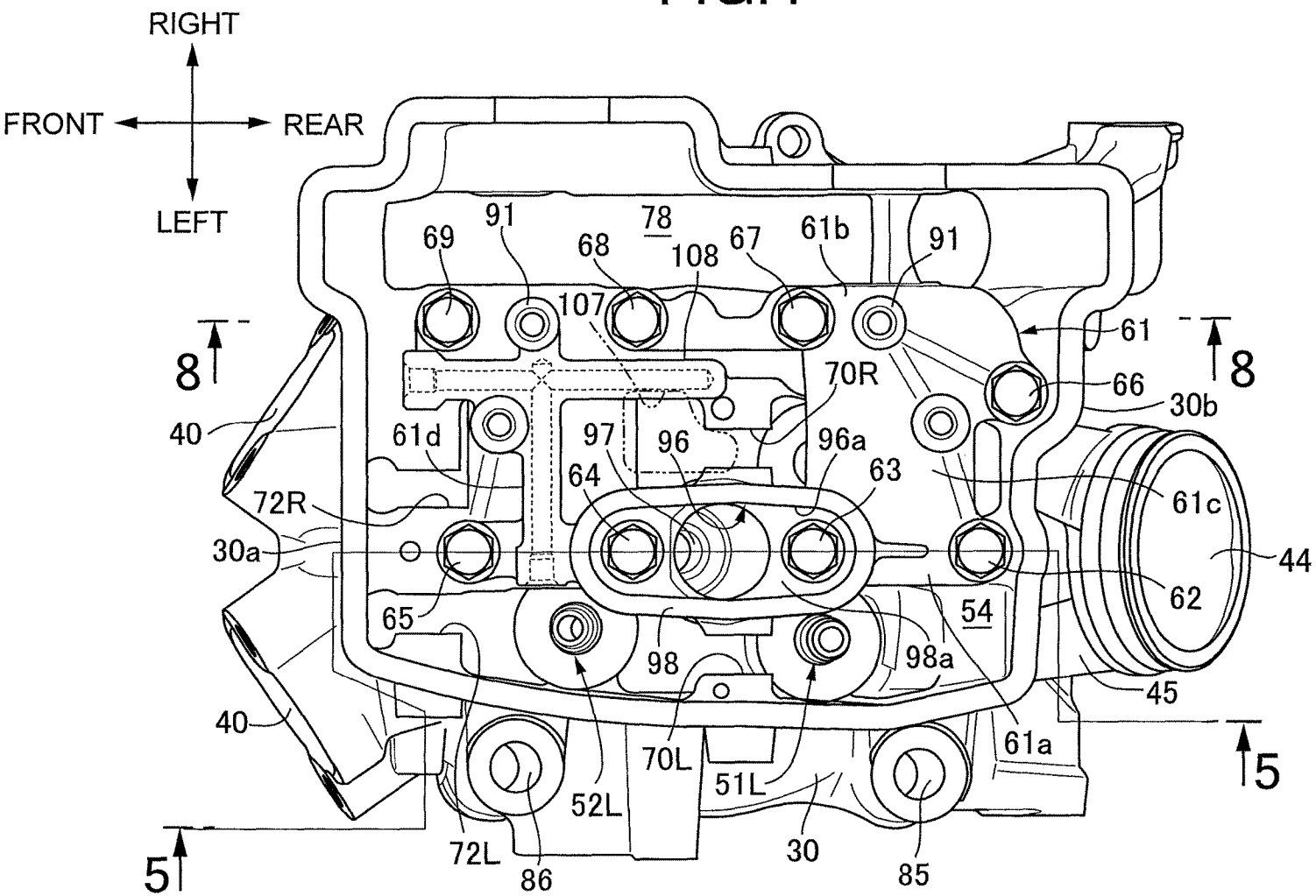
FIG. 4 is a view of a cylinder head when viewed from the arrow direction along the line 4-4 in FIG. 2.

With reference also to FIG. 4, a pair of left and right exhaust ports 40 are arranged in a front wall 30*a* of the cylinder head 30, and an exhaust device 41 of the internal combustion engine E includes a pair of exhaust pipes 42 and a pair of left and right mufflers 43 as shown clearly in FIG. 1, the pair of exhaust pipes 42 respectively coming around the left and right of the engine body 20 with the upstream side ends of the exhaust pipes 42 being connected to the exhaust ports 40, the pair of left and right mufflers 43 being connected respectively to the downstream side ends of the exhaust pipes 42 and being disposed above the rear wheel WR.

On a rear wall 30*b* of the cylinder head 30, an intake connection pipe portion 45 that configures a single intake port 44 is protrudingly arranged obliquely upward to the rear, and an intake device 46 of the internal combustion engine E includes a throttle body 47, an insulator 48, a connecting tube 49, and an air cleaner 50, the throttle body 47 adjusting the air quantity that is supplied to the intake port 44, the insulator 48 connecting the intake connection pipe portion 45 and the throttle body 47 to each other, the downstream side end of the connecting tube 49 being connected to the upstream side end of the throttle body 47, the air cleaner 50 being disposed below the riding seat 37 so that the upstream side end of the connecting tube 49 is connected to the air cleaner 50 (refer to FIG. 1).

Figure 5:
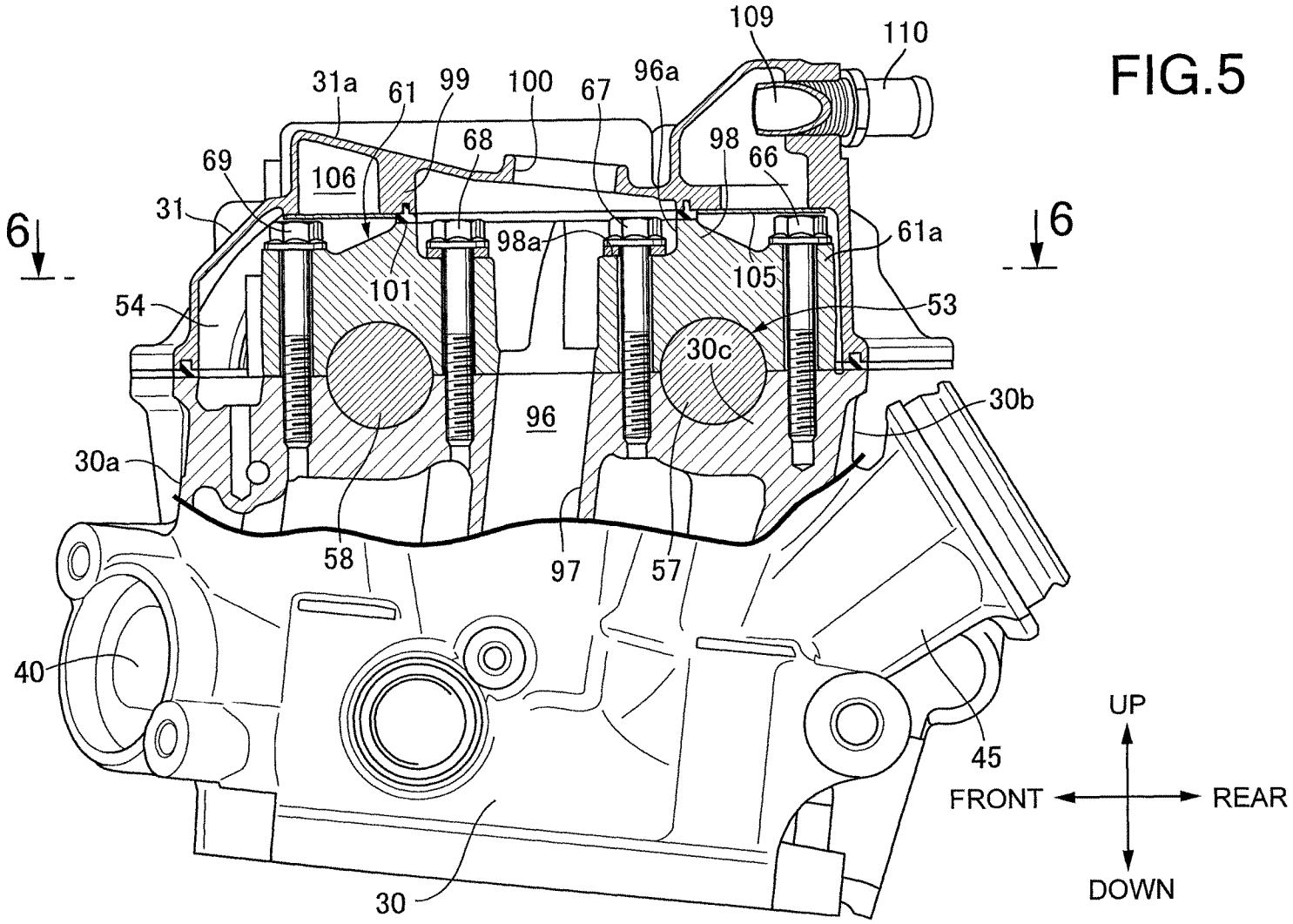
FIG. 5 is a sectional view taken from the line 5-5 of FIG. 4.
Figure 6:
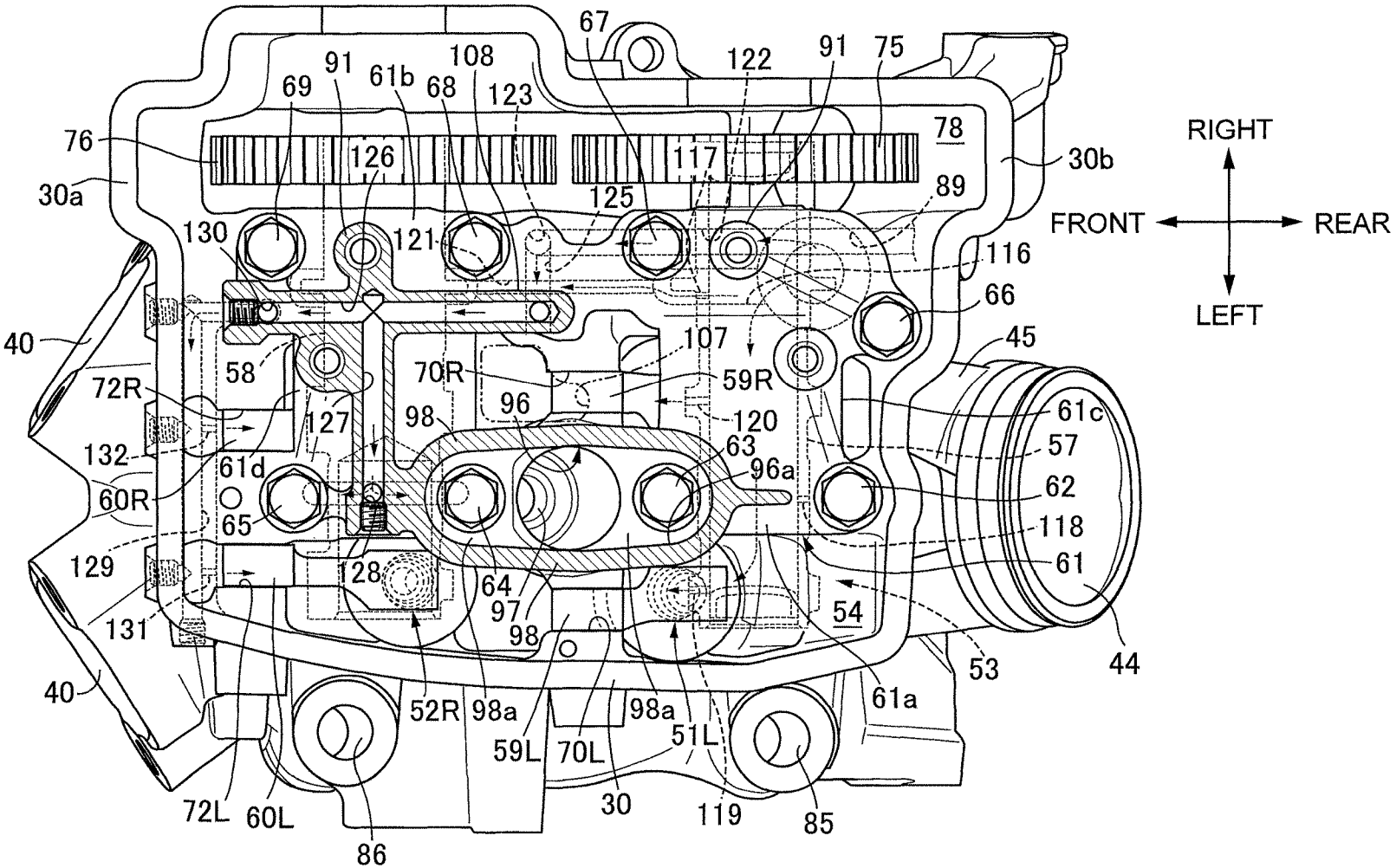
FIG. 6 is a sectional view taken from the line 6-6 of FIG. 5.
Figure 7:
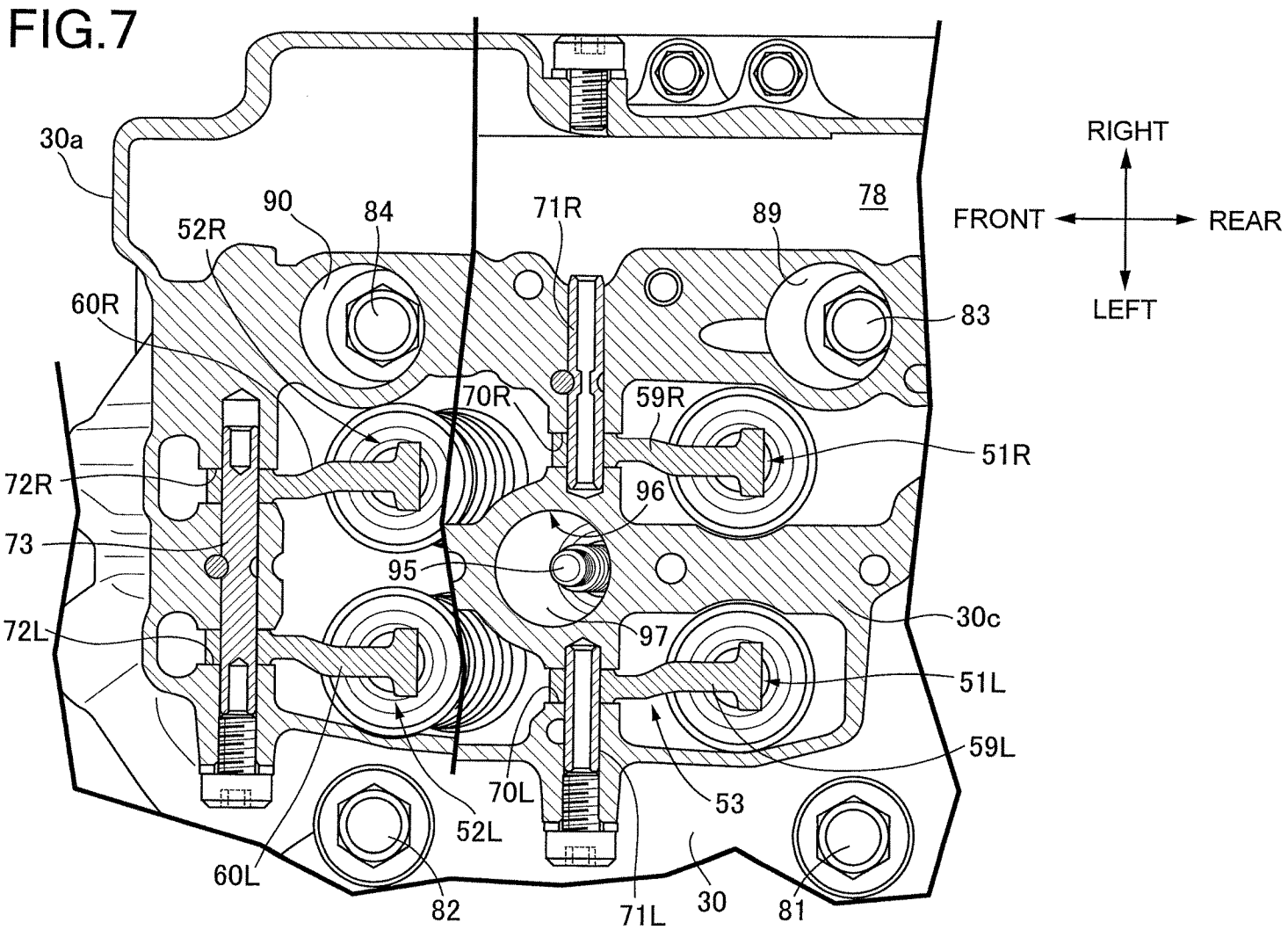
FIG. 7 a sectional view taken from the line 7-7 of FIG. 2.

With reference also to FIG. 5 to FIG. 7, in the cylinder head 30, a pair of intake valves 51L, 51R and a pair of exhaust valves 52L, 52R are disposed so as to be capable of opening/closing motion, the pair of intake valves 51L, 51R being arrayed in the vehicle width direction, the pair of exhaust valves 52L, 52R being arrayed in the vehicle width direction in the front in the vehicle longitudinal direction of the intake valves 51L, 51R, and a valve chamber 54 is formed between the cylinder head 30 and the head cover 31, the valve chamber 54 storing a valve train 53 that openably/closably drives the intake valves 51L, 51R and the exhaust valves 52L, 52R.

The valve train 53 includes an intake side camshaft 57 and an exhaust side camshaft 58, intake side rocker arms 59L, 59R, and exhaust side rocker arms 60L, 60R, the intake side camshaft 57 and the exhaust side camshaft 58 extending in the vehicle width direction at positions that are apart from each other in the vehicle longitudinal direction, the intake side rocker arms 59L, 59R swinging according to rotation of the intake side camshaft 57 and openably/closably driving the intake valves 51L, 51R, the exhaust side rocker arms 60L, 60R swinging according to rotation of the exhaust side camshaft 58 and openably/closably driving the exhaust valves 52L, 52R.

The intake side camshaft 57 and the exhaust side camshaft 58 are rotatably supported by a shaft support portion 30*c* and a cam holder 61, the shaft support portion 30*c* being integrally arranged in the cylinder head 30, the cam holder 61 being fastened to the shaft support portion 30*c*, and the cam holder 61 is forming so as to integrally include a left rotation support portion 61*a*, a right rotation support portion 61*b*, a rear connection portion 61*c*, and a front connection portion 61*d*, the left rotation support portion 61*a* extending in the vehicle longitudinal direction so as to rotatably support, between the shaft support portion 30*c* and the left rotation support portion 61*a*, a portion on the left side in the vehicle width direction of the intake side camshaft 57 and the exhaust side camshaft 58, the right rotation support portion 61*b* extending in the vehicle longitudinal direction so as to rotatably support, between the shaft support portion 30*c* and the right rotation support portion 61*b*, a portion on the right side in the vehicle width direction of the intake side camshaft 57 and the exhaust side camshaft 58 and being disposed on the right side in the vehicle width direction of the left rotation support portion 61*a*, the rear connection portion 61*c* connecting rear portions to each other and covering the intake side camshaft 57, the rear portions being along the vehicle longitudinal direction of the left rotation support portion 61*a* and the right rotation support portion 61*b*, the front connection portion 61*d* connecting front portions to each other and covering the exhaust side camshaft 58, the front portions being along the vehicle longitudinal direction of the left rotation support portion 61*a* and the right rotation support portion 61*b*.

The cam holder 61 is fastened to the shaft support portion 30*c* of the cylinder head 30 by a plurality of, for example eight of first to eighth cam holder attaching bolts 62 to 69, and the left rotation support portion 61*a* of the cam holder 61 is fastened to the shaft support portion 30*c* by the first and second cam holder attaching bolts 62, 63 and the third and fourth cam holder attaching bolts 64, 65, the first and second cam holder attaching bolts 62, 63 being disposed on opposite sides of the intake side camshaft 57, the third and fourth cam holder attaching bolts 64, 65 being disposed on opposite sides of the exhaust side camshaft 58. Also, the right rotation support portion 61*b* of the cam holder 61 is fastened to the shaft support portion 30*c* by the fifth and sixth cam holder attaching bolts 66, 67 and the seventh and eighth cam holder attaching bolts 68, 69, the fifth and sixth cam holder attaching bolts 66, 67 being disposed on opposite sides of the intake side camshaft 57, the seventh and eighth cam holder attaching bolts 68, 69 being disposed on opposite sides of the exhaust side camshaft 58.

One intake valve 51L out of a pair of the intake valves 51L, 51R is disposed on the left side in the vehicle width direction of the left rotation support portion 61*a* and below the intake side camshaft 57, and one exhaust valve 52L out of a pair of the exhaust valves 52L, 52R is disposed on the left side in the vehicle width direction of the left rotation support portion 61*a* and below the exhaust side camshaft 58. Also, the other intake valve 51R is disposed between the left rotation support portion 61*a* and the right rotation support portion 61*b* and below the intake side camshaft 57, and the other exhaust valve 52R is disposed between the left rotation support portion 61*a* and the right rotation support portion 61*b* and below the exhaust side camshaft 58.

Base portions of the intake side rocker arms 59L, 59R are disposed at slits 70L, 70R that are formed in the shaft support portion 30*c* of the cylinder head 30 in the front in the vehicle longitudinal direction of the intake side camshaft 57, and are swingably supported respectively by intake side rocker shafts 71L, 71R that are fixed to the shaft support portion 30*c*. Also, base portions of the exhaust side rocker arms 60L, 60R are disposed at slits 72L, 72R that are formed in the shaft support portion 30*c* of the cylinder head 30 in the front in the vehicle longitudinal direction of the exhaust side camshaft 58, and are swingably supported by a common exhaust side rocker shaft 73 that is fixed to the shaft support portion 30*c*.

Figure 8:
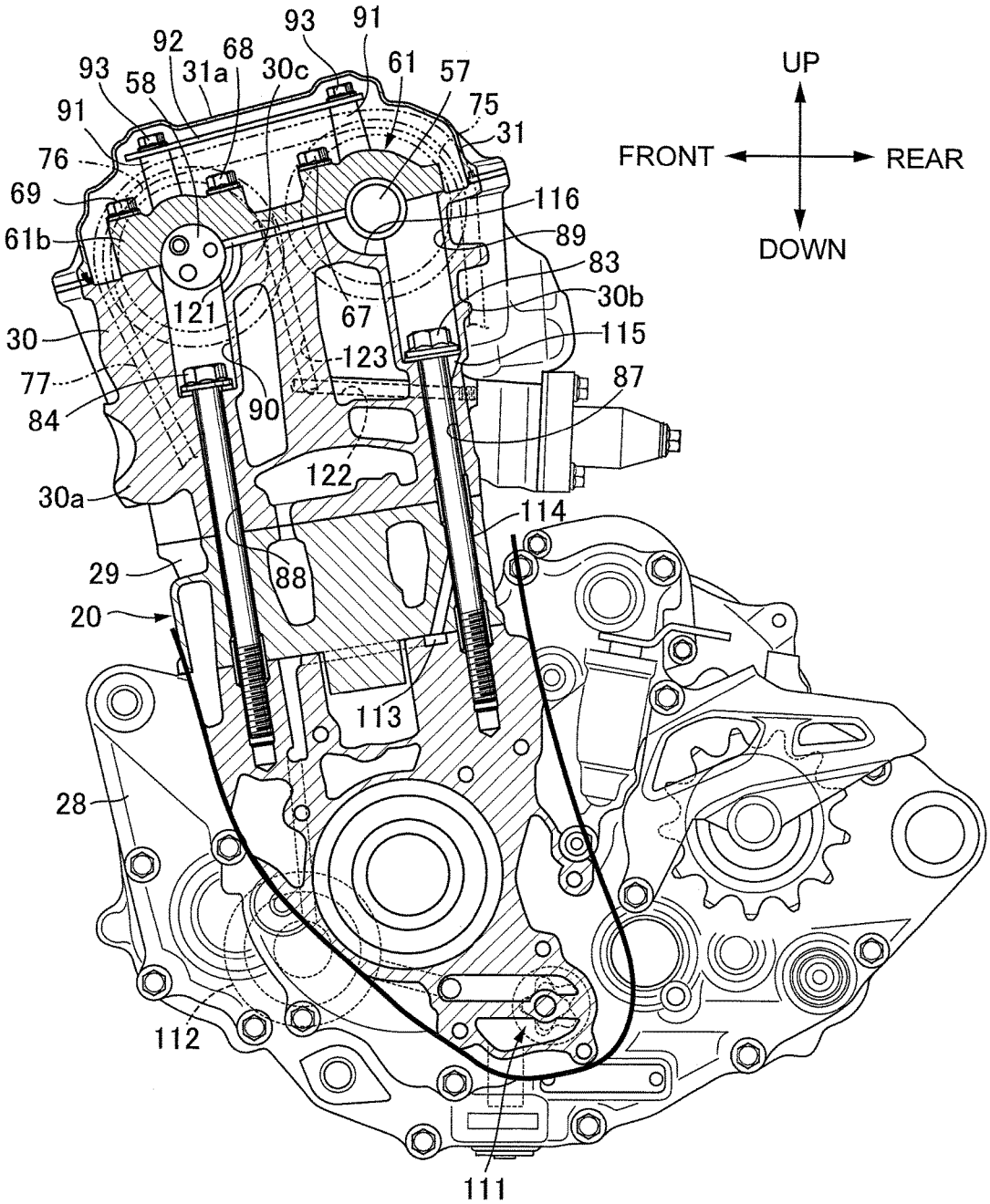
FIG. 8 is a longitudinal sectional side view of an engine body showed along the line 8-8 of FIG. 4.

With reference also to FIG. 8, driven sprockets 75, 76 are fixed to protruding end portions of the intake side camshaft 57 and the exhaust side camshaft 58 from the right rotation support portion 61*b* of the cam holder 61, and a cam chain 77 is wound around the driven sprockets 75, 76, the cam chain 77 transmitting rotational power to the intake side camshaft 57 and the exhaust side camshaft 58. Also, a cam chain chamber 78 is formed in the crankcase 28, the cylinder body 29, and the cylinder head 30, the cam chain chamber 78 allowing the cam chain 77 to travel.

In the right rotation support portion 61*b* of the cam holder 61, a pair of boss portions 91 are integrally formed protrudingly, the pair of boss portions 91 protruding to the head cover 31 side at positions corresponding to the intake side camshaft 57 and the exhaust side camshaft 58 respectively, and a chain cover 92 is fastened to the boss portions 91 respectively by bolts 93, the chain cover 92 covering the cam chain 77 from above.

Also, the cylinder head 30 and the cylinder body 29 are fastened to the crankcase 28 by first to fourth through bolts 81 to 84 that are inserted to the cylinder head 30 and the cylinder body 29 and are screwed into the crankcase 28. First and second insertion holes 85, 86 are arranged at the outer side of the valve chamber 54 and in the left wall portions of the cylinder head 30 and the cylinder body 29, the first and second insertion holes 85, 86 allowing the first and second through bolts 81, 82 to be inserted through the first and second insertion holes 85, 86, a third insertion hole 87 is arranged in the cylinder head 30 and the cylinder body 29 so as to be disposed below the intake side camshaft 57 at a position corresponding to the right rotation support portion 61*b* of the cam holder 61, the third insertion hole 87 allowing the third through bolt 83 to be inserted through the third insertion hole 87, and a fourth insertion hole 88 is arranged in the cylinder head 30 and the cylinder body 29 so as to be disposed below the exhaust side camshaft 58 at a position corresponding to the right rotation support portion 61*b* of the cam holder 61, the fourth insertion hole 88 allowing the fourth through bolt 84 to be inserted through the fourth insertion hole 88.

Also, operation holes 89, 90 connected co-axially to the upper ends of the third and fourth insertion holes 87, 88 are formed in the shaft support portion 30*c* of the cylinder head 30 and formed to have a diameter larger than that of the third and fourth insertion holes 87, 88 so as to allow rotation operation for the third and fourth insertion bolts 83, 84, and the upper ends of these operation holes 89, 90 open at the upper end of the shaft support portion 30*c* at positions corresponding to the right rotation support portion 61*b* of the cam holder 61.

Figure 9:
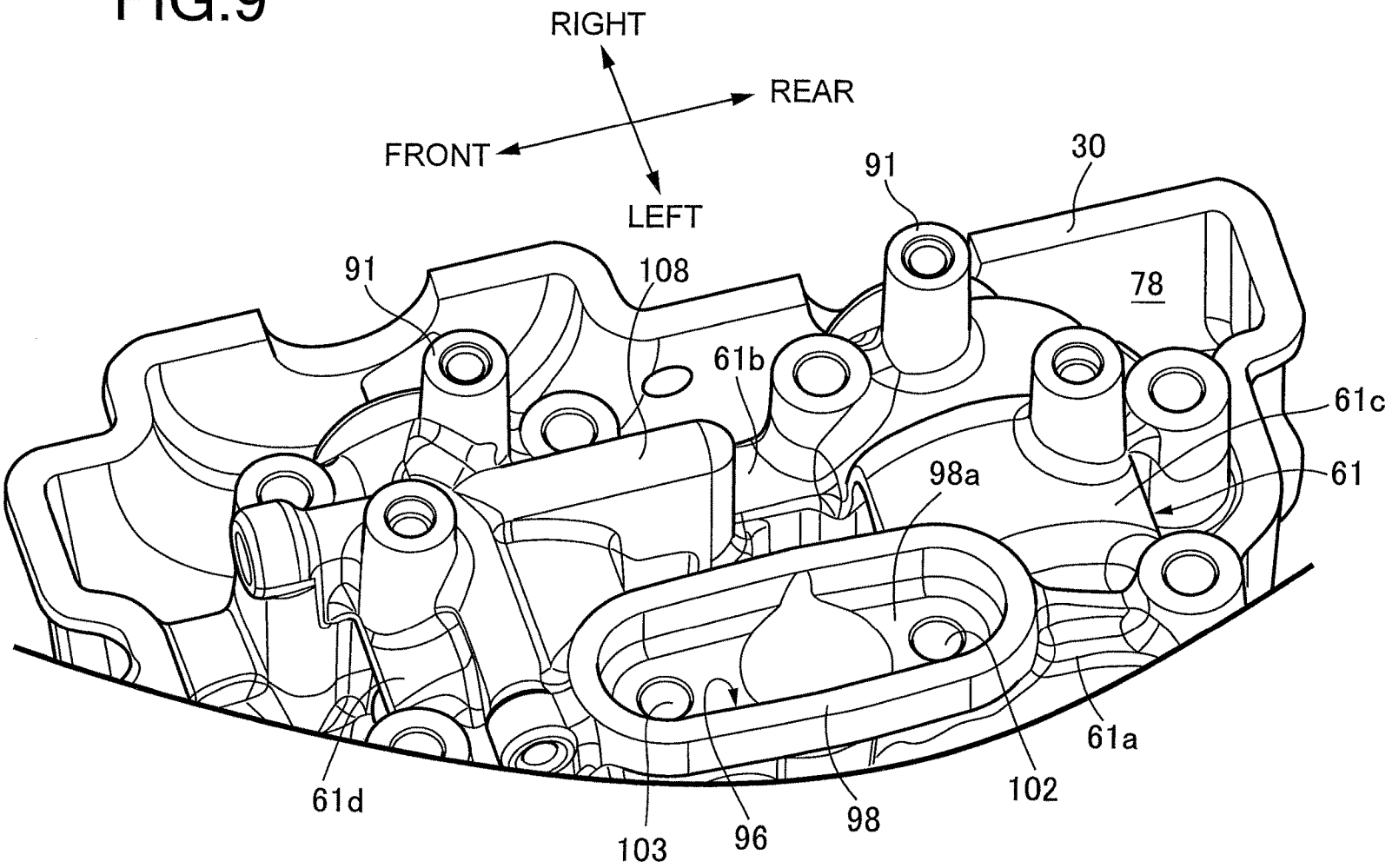
FIG. 9 is a perspective view of the upper portion of a part of the cylinder head when viewed from left front diagonally above.

With reference also to FIG. 9, a plug hole 96 for inserting therethrough an ignition plug 95 (refer to FIG. 7) is arranged striding between the cylinder head 30 and the head cover 31, the head cover 31 being joined to the cylinder head 30, the ignition plug 95 being attached to the cylinder head 30. This plug hole 96 is configured with a plug hole 97, a cam holder side tubular portion 98, a head cover side tubular portion 99, and a through-hole 100, the plug hole 97 being formed in the shaft support portion 30*c* of the cylinder head 30, the cam holder side tubular portion 98 being integrally arranged in the left rotation support portion 61*a* of the cam holder 61 so as to be continuous to the plug hole 97, the head cover side tubular portion 99 being integrally arranged in the head cover 31 with a gasket 101 being interposed between the head cover side tubular portion 99 and the upper end of the cam holder side tubular portion 98, the through-hole 100 being arranged in a ceiling wall 31*a* of the head cover 31 so as to be continuous to the head cover side tubular portion 99.

A portion of the gasket 101 that is interposed between the cam holder side tubular portion 98 and the head cover side tubular portion 99 is formed so as to be connected integrally to a portion that is interposed between the cylinder head 30 and the head cover 31.

The plug hole 96 is formed striding between the cylinder head 30 and the head cover 31 with such layout that the intake side camshaft 57 and the exhaust side camshaft 58 are positioned on both sides in the front and rear of the plug hole 96, the intake side camshaft 57 and the exhaust side camshaft 58 being sandwiched between the shaft support portion 30*c* of the cylinder head 30 and the cam holder 61. A long hole portion 96*a* is formed in a part of the plug hole 96, the long hole portion 96*a* being formed long in a direction orthogonal to the axes of the intake side camshaft 57 and the exhaust side camshaft 58, the long hole portion 96*a* is formed by making the cam holder side tubular portion 98 and the head cover side tubular portion 99 have a cross-section of an elliptical shape that extends long in a direction orthogonal to the axes of the intake side camshaft 57 and the exhaust side camshaft 58, and a step portion 98*a* is formed within the cam holder side tubular portion 98, the step portion 98*a* facing the head cover 31 side.

Within the long hole portion 96*a* of the plug hole 96, a part of the first to eighth cam holder attaching bolts 62 to 69 are disposed, the cam holder attaching bolts 62 to 69 being used for fastening the cam holder 61 to the shaft support portion 30*c* of the cylinder head 30. In this embodiment, the second and third cam holder attaching bolts 63, 64 out of the first to eighth cam holder attaching bolts 62 to 69 are disposed within the long hole portion 96*a*, the second and third cam holder attaching bolts 63, 64 being disposed between the intake side camshaft 57 and the exhaust side camshaft 58, the first to eighth cam holder attaching bolts 62 to 69 being disposed respectively on both sides of the intake side camshaft 57 and the exhaust side camshaft 58, and insertion holes 102, 103 are arranged in the cylinder head 30 so as to open at the step portion 98*a* that is within the cam holder side tubular portion 98, the insertion holes 102, 103 allowing the second and third cam holder attaching bolts 63, 64 to be inserted through the insertion holes 102, 103.

Figure 10:
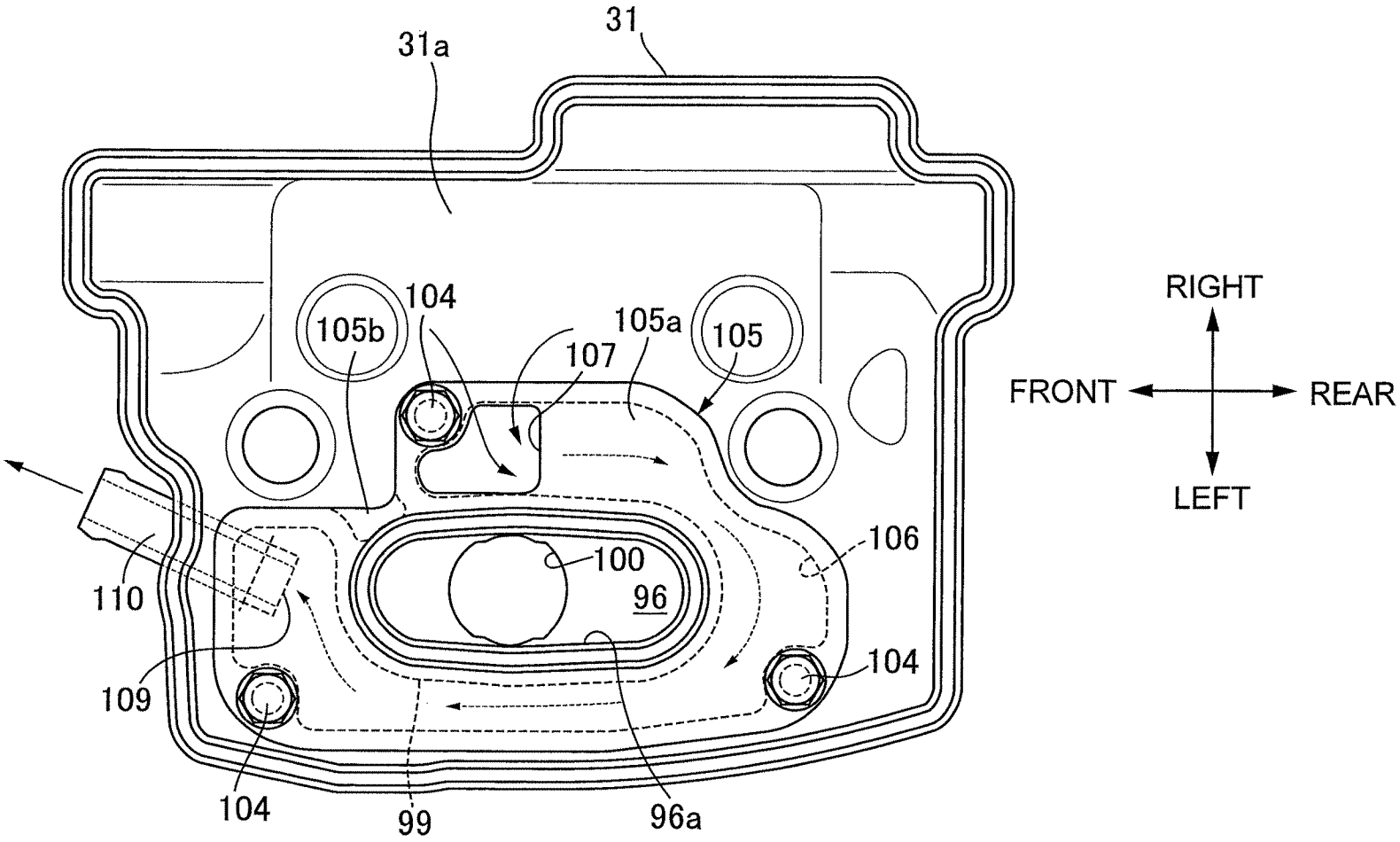
FIG. 10 is a view of when the head cover when viewed from arrow direction along the line 10-10 in FIG. 2.

With reference also to FIG. 10, a breather chamber 106 is formed between a breather plate 105 and the head cover 31, the breather chamber 106 being disposed around the long hole portion 96*a*, the breather plate 105 being attached to the head cover 31 by, for example, three bolts 104.

The breather chamber 106 is formed so as to surround the long hole portion 96*a* of the plug hole 96, an inlet 107 of the breather chamber 106 is formed in the breather plate 105 so as to be positioned between the plug hole 96 and the cam chain chamber 78 on a projection view (FIG. 4) to the second flat plane PL2 that is parallel to the joining surface of the cylinder head 30 and the head cover 31, and a partition wall 108 is arranged integrally in the right rotation support portion 61*b* of the cam holder 61 so as to protrude toward the head cover 31 side, the partition wall 108 being disposed between the cam chain chamber 78 and the inlet 107 on the projection view described above.

The inlet 107 of the breather chamber 106 is disposed at the center portion of the head cover 31 on a projection view (FIG. 10) to the second flat plane PL2 that is parallel to the joining surface of the cylinder head 30 and the head cover 31.

The breather plate 105 is formed so as to integrally include a breather plate main portion 105*a* and a connecting portion 105*b*, the breather plate main portion 105*a* being formed into a substantially U-shape so as to surround the long hole portion 96*a*, the connecting portion 105*b* connecting opposite end portions of the breather plate main portion 105*a*, and the inlet 107 and an outlet 109 of the breather chamber 106 are disposed at positions sandwiching the connecting portion 105*b* therebetween. The outlet 109 is formed at the inner end of a lead out tube 110 that is attached to the head cover 31 so that gas from the breather chamber 106 is led out to the air cleaner 50 side in the intake device 46.

Watching FIG. 8, an oil pump 111 is disposed within the crankcase 28, the oil pump 111 pumping up the oil within the crankcase 28, and the oil fed out from this oil pump 111 is guided to a first lubricating oil passage 113 through an oil filter 112, the first lubricating oil passage 113 being formed between the crankcase 28 and the cylinder body 29, the oil filter 112 being disposed in the crankcase 28.

A second lubricating oil passage 114 for guiding a lubricating oil to the cylinder head 30 side is formed between the outer periphery of the third through bolt 83 and the inner periphery of the third insertion hole 87, so as to communicate with the first lubricating oil passage 113, the third through bolt 83, out of the first to fourth through bolts 81 to 84 used for fastening the cylinder body 29 and the cylinder head 30 to the crankcase 28, being disposed at the right rear portion of the cylinder head 30, the third insertion hole 87 being arranged in the cylinder body 29 and the cylinder head 30 for allowing the third through bolt 83 to be inserted through the third insertion hole 87, and this second lubricating oil passage 114 is communicated with the operation hole 89 through a cutout 115 that is formed at the upper end of the third insertion hole 87. Also, in the shaft support portion 30*c* of the cylinder head 30, a first groove 116 is formed so as to communicate with the operation hole 89, the first groove 116 being used for storing oil that lubricates a gap between the intake side camshaft 57 and the right rotation support portion 61*b* of the cam holder 61 and a gap between the intake side camshaft 57 and the shaft support portion 30*c*.

Watching FIG. 6, the intake side camshaft 57 is formed into a hollow tubular shape with closed opposite ends, and a communication hole 117, a communication hole 118, and oil injection holes 119, 120 are arranged in the intake side camshaft 57, the communication hole 117 being disposed at a position corresponding to the left rotation support portion 61*a* of the cam holder 61, the communication hole 118 being disposed at a position corresponding to the right rotation support portion 61*b* of the cam holder 61 and communicating with the first groove 116, the oil injection holes 119, 120 opening toward the intake valves 51L, 51R and the intake side rocker arms 59L, 59R.

In the joining surface of the right rotation support portion 61*b* of the cam holder 61 to the shaft support portion 30*c*, a second groove 121 is formed, the second groove 121 guiding the lubricating oil from the first groove 116 to a gap between the right rotation support portion 61*b* of the cam holder 61 and the exhaust side camshaft 58 and a gap between the shaft support portion 30*c* and the exhaust side camshaft 58.

Watching FIG. 8, in the cylinder head 30, a third lubricating oil passage 122 is formed, the third lubricating oil passage 122 diagonally crossing the third insertion hole 87 so as to communicate with the second lubricating oil passage 114, and the inner end of this third lubricating oil passage 122 is communicated with the lower end of a fourth lubricating oil passage 123 that extends up and down within the cylinder head 30.

As shown in FIG. 8, the upper end of the fourth lubricating oil passage 123 is formed in the right rotation support portion 61*b* of the cam holder 61 and communicated with the outer end of a fifth lubricating oil passage 125 extending to the partition wall 108 side. Within the partition wall 108, a sixth lubricating oil passage 126 is formed, the sixth lubricating oil passage 126 extending in the longitudinal direction of the partition wall 108, and the inner end of the fifth lubricating oil passage 125 is communicated with one end of the sixth lubricating oil passage 126. Also, a seventh lubricating oil passage 127 is formed within the front connection portion 61*d* in the cam holder 61, one end of the seventh lubricating oil passage 127 being communicated with the intermediate portion of the sixth lubricating oil passage 126, and a through-hole 128 is arranged in the left rotation support portion 61*a* so as to communicate with the seventh lubricating oil passage 127, the through-hole 128 being used for supplying the lubricating oil to a gap between the left rotation support portion 61*a* of the cam holder 61 and the exhaust side camshaft 58 and a gap between the shaft support portion 30*c* and the exhaust side camshaft 58.

In the meantime, in the front wall 30*a* of the cylinder head 30, an eighth lubricating oil passage 129 that extends in the vehicle width direction is formed, the other end portion of the sixth lubricating oil passage 126 is communicated with the eighth lubricating oil passage 129 through a communication passage 130 that is formed in the right rotation support portion 61*b* of the cam holder 61 and the shaft support portion 30*c*, and oil injection holes 131, 132 open toward the exhaust valves 52L, 52R side and the exhaust side rocker arms 60L, 60R side and are arranged in the front wall 30*a* of the cylinder head 30, the oil injection holes 131, 132 communicating with the eighth lubricating oil passage 129.

In other words, the sixth lubricating oil passage 126 is formed in the partition wall 108 of the cam holder 61, the sixth lubricating oil passage 126 being used for circulating the lubricating oil to the exhaust side camshaft 58 side.

Next, the operation of this embodiment will be explained. The long hole portion 96*a* is formed as a part of the plug hole 96 that is arranged striding between the cylinder head 30 and the head cover 31, the long hole portion 96*a* being formed long in the direction orthogonal to the axes of the intake side camshaft 57 and the exhaust side camshaft 58, the second and third cam holder attaching bolts 63, 64, among the first to eighth cam holder attaching bolts 62 to 69 used for fastening the cam holder 61 to the cylinder head 30, are disposed within the long hole portion 96*a*, and the breather chamber 106 is formed between the breather plate 105 and the head cover 31, the breather chamber 106 being disposed around the long hole portion 96*a*, the breather plate 105 being attached to the head cover 31. Therefore, the gas circulation route within the breather chamber 106 is made comparatively long even in the single cylinder so that the gas/liquid separation performance can be improved. In addition, even when a part of the plug hole 96 is formed as the long hole portion 96*a*, the disposal space for the cam holder attaching bolt which should be secured outside the plug hole 96 is prevented from becoming large so as to be able to contribute to compactization of the internal combustion engine E.

Also, the breather chamber 106 is formed so as to surround the long hole portion 96*a* of the plug hole 96, a part of the cam chain chamber 78 is formed in the cylinder head 30, the cam chain 77 being disposed in the cam chain chamber 78, the cam chain 77 transmitting rotational power to the intake side camshaft 57 and the exhaust side camshaft 58, the inlet 107 of the breather chamber 106 is formed in the breather plate 105 so as to be positioned between the plug hole 96 and the cam chain chamber 78 on the projection view to the second flat plane PL2 that is parallel to the joining surface of the cylinder head 30 and the head cover 31, and the partition wall 108 is arranged integrally in the cam holder 61 so as to protrude toward the head cover 31 side, the partition wall 108 being disposed between the cam chain chamber 78 and the inlet 107 on the projection view. Therefore, the gas circulation route from the inlet 107 to the outlet 109 of the breather chamber 106 can be made long, intrusion of the oil mist to the inlet 107 of the breather chamber 106 from the cam chain chamber 78 side can be suppressed by the partition wall 108, and the breather performance can be improved.

Also, since the sixth lubricating oil passage 126 for guiding the lubricating oil to the exhaust side camshaft 58 side is formed within the partition wall 108, increase of the weight of the cam holder 61 and increase of the weight of the engine body 20 caused by provision of the partition wall 108 can be suppressed.

Also, the breather plate 105 is formed so as to integrally include the breather plate main portion 105*a* and the connecting portion 105*b*, the breather plate main portion 105*a* surrounding the long hole portion 96*a* and being formed into a substantially U-shape, the connecting portion 105*b* connecting opposite end portions of the breather plate main portion 105*a* to each other, the inlet 107 and the outlet 109 of the breather chamber 106 are disposed at positions that sandwich the connecting portion 105*b* therebetween, therefore the rigidity of the breather plate 105 can be secured while securing the gas circulation route in the breather chamber 106 long. As a result, it can contribute to improvement of the productivity and the assembly performance of the breather plate 105.

Also, since the inlet 107 of the breather chamber 106 is disposed at the center portion of the head cover 31 on the projection view to the second flat plane PL2 that is parallel to the joining surface of the cylinder head 30 and the head cover 31, even when the cylinder axis C may be tilted largely, the inlet 107 of the breather chamber 106 comes to be disposed higher than the lower portion of the space between the cylinder head 30 and the head cover 31, namely the valve chamber 54, intrusion of the oil mist to the breather chamber 106 can be suppressed, and the breather performance can be further improved.

Also, among the first to eighth cam holder attaching bolts 62 to 69 respectively disposed on both sides of the intake side camshaft 57 and the exhaust side camshaft 58, the second and third cam holder attaching bolts 63, 64 disposed between the intake side camshaft 57 and the exhaust side camshaft 58 are disposed within the long hole portion 96*a*. Therefore, the cylinder head 30 can be made compact, the second and third cam holder attaching bolts 63, 64 disposed between the intake side camshaft 57 and the exhaust side camshaft 58 are prevented from interfering with the breather chamber 106, and thereby the breather chamber 106 can be formed larger and the breather performance can be further improved.

Although the embodiment according to the present invention has been explained above, the present invention is not limited to the aforesaid embodiment, and various changes in design can be made without departing from the gist of the present invention.

What is claimed is:

1. A single cylinder internal combustion engine, in which a plug hole is provided striding between a cylinder head and a head cover joined to the cylinder head, and an intake side camshaft and an exhaust side camshaft are disposed at positions that sandwich the plug hole therebetween, the intake side camshaft and the exhaust side camshaft being sandwiched between the cylinder head and a cam holder joined to the cylinder head, wherein a long hole portion is formed as a part of the plug hole, the long hole portion being formed long in a direction orthogonal to axes of the intake side camshaft and the exhaust side camshaft, wherein a part of a plurality of cam holder attaching bolts are disposed within the long hole portion of the plug hole, the plurality of cam holder attaching bolts being used for fastening the cam holder to the cylinder head, wherein a breather chamber is formed between a breather plate and the head cover, the breather chamber being disposed around the long hole portion, the breather plate being attached to the head cover, wherein the breather chamber is formed so as to surround the long hole portion of the plug hole, wherein a part of a cam chain chamber is formed in the cylinder head, the cam chain chamber being provided with a cam chain transmitting rotational power to the intake side camshaft and the exhaust side camshaft, wherein an inlet of the breather chamber is formed in the breather plate so as to be positioned between the plug hole and the cam chain chamber on a projection view to a flat plane that is parallel to a joining surface of the cylinder head and the head cover, wherein a partition wall is arranged integrally with the cam holder so as to protrude to the head cover side, the partition wall being disposed between the cam chain chamber and the inlet on the projection view, wherein a lubricating oil passage is formed within the partition wall, the lubricating oil passage guiding a lubricating oil to the exhaust side camshaft side.

2. The single cylinder internal combustion engine according to claim 1, wherein the breather plate is formed integrally with a breather plate main portion and a connecting portion, the breather plate main portion being formed in a substantially U-shape surrounding the long hole portion, the connecting portion connecting opposite end portions of the breather plate main portion to each other, and wherein the inlet and an outlet of the breather chamber are disposed at positions that sandwich the connecting portion therebetween.

3. The single cylinder internal combustion engine according to claim 1, wherein a pair of the cam holder attaching bolts of the plurality of cam holder attaching bolts are disposed within the long hole portion and between the intake side camshaft and the exhaust side camshaft.

4. A single cylinder internal combustion engine, in which a plug hole is provided striding between a cylinder head and a head cover joined to the cylinder head, and an intake side camshaft and an exhaust side camshaft are disposed at positions that sandwich the plug hole therebetween, the intake side camshaft and the exhaust side camshaft being sandwiched between the cylinder head and a cam holder joined to the cylinder head, wherein a long hole portion is formed as a part of the plug hole, the long hole portion being formed long in a direction orthogonal to axes of the intake side camshaft and the exhaust side camshaft, wherein a part of a plurality of cam holder attaching bolts are disposed within the long hole portion of the plug hole, the plurality of cam holder attaching bolts being used for fastening the cam holder to the cylinder head, wherein a breather chamber is formed between a breather plate and the head cover, the breather chamber being disposed around the long hole portion, the breather plate being attached to the head cover, wherein the breather chamber is formed so as to surround the long hole portion of the plug hole, wherein a part of a cam chain chamber is formed in the cylinder head, the cam chain chamber being provided with a cam chain transmitting rotational power to the intake side camshaft and the exhaust side camshaft, wherein an inlet of the breather chamber is formed in the breather plate so as to be positioned between the plug hole and the cam chain chamber on a projection view to a flat plane that is parallel to a joining surface of the cylinder head and the head cover, wherein a partition wall is arranged integrally with the cam holder so as to protrude to the head cover side, the partition wall being disposed between the cam chain chamber and the inlet on the projection view, wherein the breather plate is formed integrally with a breather plate main portion and a connecting portion, the breather plate main portion being faulted in a substantially U-shape surrounding the long hole portion, the connecting portion connecting opposite end portions of the breather plate main portion to each other, and wherein the inlet and an outlet of the breather chamber are disposed at positions that sandwich the connecting portion therebetween.

5. The single cylinder internal combustion engine according to claim 4, wherein the inlet of the breather chamber is disposed at a center portion of the head cover on the projection view to the flat plane that is parallel to the joining surface of the cylinder head and the head cover.

6. The single cylinder internal combustion engine according to claim 4, wherein a pair of the cam holder attaching bolts of the plurality of cam holder attaching bolts are disposed within the long hole portion and between the intake side camshaft and the exhaust side camshaft.

7. An internal combustion engine, in which a plug hole is provided striding between a cylinder head and a head cover joined to the cylinder head, and a camshaft is disposed at a position sandwiched between the cylinder head and a cam holder joined to the cylinder head, wherein a breather chamber is formed between a breather plate and the head cover, the breather chamber being disposed around the plug hole so as to surround a part of the plug hole, the breather plate being attached to the head cover, wherein a part of a cam chain chamber is formed in the cylinder head, the cam chain chamber being provided with a cam chain transmitting rotational power to the camshaft, wherein an inlet of the breather chamber is formed in the breather plate so as to be positioned between the plug hole and the cam chain chamber on a projection view to a flat plane that is parallel to a joining surface of the cylinder head and the head cover, wherein a partition wall is arranged integrally with the cam holder so as to protrude to the head cover side, the partition wall being disposed between the cam chain chamber and the inlet on the projection view, and wherein a lubricating oil passage is formed within the partition wall, the lubricating oil passage guiding a lubricating oil to the camshaft side.

8. The internal combustion engine according to claim 7, wherein the breather plate is formed integrally with a breather plate main portion and a connecting portion, the breather plate main portion being formed in a substantially U-shape surrounding the plug hole, the connecting portion connecting opposite end portions of the breather plate main portion to each other, and wherein the inlet and an outlet of the breather chamber are disposed at positions that sandwich the connecting portion therebetween.

9. The internal combustion engine according to claim 7, wherein the inlet of the breather chamber is disposed at a center portion of the head cover on the projection view to the flat plane that is parallel to the joining surface of the cylinder head and the head cover.

10. The internal combustion engine according to claim 8, wherein the inlet of the breather chamber is disposed at a center portion of the head cover on the projection view to the flat plane that is parallel to the joining surface of the cylinder head and the head cover.

11. The internal combustion engine according to claim 7, wherein the engine is a single cylinder internal combustion engine, wherein said camshaft comprises an intake side camshaft and an exhaust side camshaft, wherein a plurality of cam holder attaching bolts are disposed on opposite sides of the intake side and exhaust side camshafts, respectively, and a pair of the cam holder attaching bolts which are disposed between the intake side camshaft and the exhaust side camshaft of the plurality of cam holder attaching bolts are disposed within a long hole portion of the plug hole that is formed long in a direction orthogonal to axes of the intake side camshaft and the exhaust side camshaft.

12. The internal combustion engine according to claim 8, wherein the engine is a single cylinder internal combustion engine, wherein said camshaft comprises an intake side camshaft and an exhaust side camshaft, wherein a plurality of cam holder attaching bolts are disposed on opposite sides of the intake side and exhaust side camshafts, respectively, and a pair of the cam holder attaching bolts which are disposed between the intake side camshaft and the exhaust side camshaft of the plurality of cam holder attaching bolts are disposed within a long hole portion of the plug hole that is formed long in a direction orthogonal to axes of the intake side camshaft and the exhaust side camshaft.

13. The internal combustion engine according to claim 9, wherein the engine is a single cylinder internal combustion engine, wherein said camshaft comprises an intake side camshaft and an exhaust side camshaft, wherein a plurality of cam holder attaching bolts are disposed on opposite sides of the intake side and exhaust side camshafts, respectively, and a pair of the cam holder attaching bolts which are disposed between the intake side camshaft and the exhaust side camshaft of the plurality of cam holder attaching bolts are disposed within a long hole portion of the plug hole that is formed long in a direction orthogonal to axes of the intake side camshaft and the exhaust side camshaft.

14. The internal combustion engine according to claim 10, wherein the engine is a single cylinder internal combustion engine, wherein said camshaft comprises an intake side camshaft and an exhaust side camshaft, wherein a plurality of cam holder attaching bolts are disposed on opposite sides of the intake side and exhaust side camshafts, respectively, and a pair of the cam holder attaching bolts which are disposed between the intake side camshaft and the exhaust side camshaft of the plurality of cam holder attaching bolts are disposed within a long hole portion of the plug hole that is formed long in a direction orthogonal to axes of the intake side camshaft and the exhaust side camshaft.

* * * * *